US005634834A

United States Patent [19]

Cole et al.

[11] Patent Number: 5,634,834

[45] Date of Patent: Jun. 3, 1997

[54] ERGONOMIC KICKBOARD

[76] Inventors: Andrew J. Cole, 4805 St. John's Dr., Dallas, Tex. 75205; Richard A. Eagleston, 1 Trillium La., San Carlos, Calif. 94070

[21] Appl. No.: 521,629

[22] Filed: Aug. 31, 1995

[51] Int. Cl.[6] ..... A63C 15/00

[52] U.S. Cl. ..... 441/65

[58] Field of Search ..... 114/39.2, 294, 114/253, 254; 441/55, 65, 67, 68, 79

[56] References Cited

U.S. PATENT DOCUMENTS

| | | |
|---|---|---|
| D. 157,564 | 3/1950 | Byerly . |
| D. 265,116 | 6/1982 | Churchill . |
| D. 305,144 | 12/1989 | Shanelec . |
| D. 305,145 | 12/1989 | Shanelec . |
| 3,543,712 | 12/1970 | Vasilatos . |
| 4,439,165 | 3/1984 | Rothstein . |
| 4,561,664 | 12/1985 | Cashmere . |
| 4,752,260 | 6/1988 | Stewart . |
| 4,886,476 | 12/1989 | Brocone et al. . |
| 4,894,034 | 1/1990 | Brown, III . |
| 5,101,752 | 4/1992 | Smollar et al. . |
| 5,114,370 | 5/1992 | Moran . |
| 5,116,269 | 5/1992 | Moran . |
| 5,273,470 | 12/1993 | Sheddon et al. . |
| 5,389,023 | 2/1995 | McIntyre . |

FOREIGN PATENT DOCUMENTS

| | | | |
|---|---|---|---|
| 1088520 | 10/1967 | United Kingdom | 441/68 |

*Primary Examiner*—Stephen Avila
*Attorney, Agent, or Firm*—Klauber & Jackson

[57] ABSTRACT

A kickboard made of an elongate board having a top surface and a bottom surface, wherein the board has front, rear, and side edges that border the top and bottom surfaces. The bottom surface of the board is substantially convex in shape within the front and side edges. The board has a pair of elongate channels of defined depth formed in the bottom surface. The channels extend longitudinally from the rear edge toward the front edge and taper in depth near the front edge. The channels provide a variety of comfortable, ergonomically designed hand grip positions and also provide stability to the kickboard.

20 Claims, 2 Drawing Sheets

ERGONOMIC KICKBOARD

FIELD OF THE INVENTION

The present invention relates to kickboards and, more particularly, to a kickboard that provides for a variety of comfortable, ergonomically designed upper extremity hand grip positions.

DESCRIPTION OF THE PRIOR ART

Kickboards have been used for years as a training tool for swimmers, as an assistive device for rehabilitation, and as a cross-training tool for other activities and sports. Most kickboards currently on the market have a flat (planar) bottom and a rectangular shape with a slightly rounded contour. Such designs require that the kickboard be held by a user in a manner that causes his or her shoulders to be internally rotated, a position that causes shoulder impingement. Shoulder impingement syndrome is one of the most common causes of pain in an aquatic athlete. Thus, it would be desirable to design a kickboard that does not promote or result in the problem of shoulder impingement or other dysfunctional positions of the upper and lower extremity and spine.

Several patents have been issued for kickboard designs and related devices which exhibit various beneficial features. For example, U.S. Pat. Nos. 4,439,165 by Rothstein, 4,561,664 by Cashmere, 4,894,034 by Brown, III, 5,101,752 by Smollar et al., 5,116,269 by Moran, 5,114,730 by Moran, 5,273,470 by Sneddon et al., and 4,752,260 by Stewart are all directed toward kickboards or related body supporting devices. A brief description of these patents will now be given.

In U.S. Pat. No. 4,439,165, Rothstein discloses a body board having a handle at its front edge for gripping and fins on its bottom surface for steering. It should be noted that the handle is attached and located on the top surface of the body board near its front edge.

In U.S. Pat. No. 4,561,664, Cashmere discloses a toboggan having ribs on its bottom surface for traction and steering when used on snow. It should be noted that the ribs are protruding from the bottom surface and the toboggan is for use solely on snow.

In U.S. Pat. No. 4,894,034, Brown, III discloses a bodyboard having specific hand holds or grips of distinctive contour for the purpose of assisting the user in making controlled turns and other maneuvers. It should be noted that the hand holds or grips comprise a depressed surface outlining the bodyboard which is located on the top surface of the bodyboard for providing only the thumb of a user with gripping leverage.

In U.S. Pat. No. 5,101,752, Smollar et al. disclose a body board of inflatable construction having handles disposed on the top surface of the body board. It should be noted that the body board is of inflatable construction and the handles are located on the top surface of the body board.

In U.S. Pat. No. 5,116,269, Moran discloses a bodyboard of multi-element construction having a groove formed along the front and side top edges thereof for purposes of gripping by a user. It should be noted that the groove is positioned on the top surface of the bodyboard and is designed so as to provide only the thumb of the user with gripping leverage.

In U.S. Pat. No. 5,114,730, Moran discloses a bodyboard of variable stiffness so as to allow a user of the bodyboard to impose a curvature along the bottom surface of the bodyboard. It should be noted that there are no provisions designed into the bodyboard which provide gripping leverage to a user thereof.

In U.S. Pat. No. 5,273,470, Sneddon et al. discloses a bodyboard having ridges extending diagonally across the top surface of the bodyboard and a lip outlining the top surface of the bodyboard. It should be noted that the lip is located on the top surface of the bodyboard and is provided so as to provide only the thumb of a user with gripping leverage.

In U.S. Pat. No. 4,752,260, Stewart discloses a body board having raised leverage panels formed on the top surface of the body board. It should be noted that the raised leverage panels are provided so as to provide only the elbows of a user to obtain leverage thereagainst for maintaining the user's position on the bodyboard.

Although all of the above-mentioned patents are directed toward kickboards and related body supporting devices, none are directed toward a kickboard having a pair of elongate channels formed along a bottom surface thereof for purposes of providing a variety of comfortable, ergonomically designed hand grip positions and kickboard stability. Such a kickboard would be desirable to overcome the problem of shoulder impingement and other musculoskeletal dysfunctions that results from the use of other types of similar devices.

SUMMARY OF THE INVENTION

The present invention contemplates a kickboard having a pair of elongate channels formed along a bottom surface thereof for purposes of providing a variety of comfortable, ergonomically designed hand grip positions and kickboard stability.

The kickboard comprises an elongate board having a top surface and a bottom surface, and the board has front, rear, and side edges that border the top and bottom surfaces. The board is tapered in width from the front edge to the rear edge. The bottom surface of the board is substantially convex in shape within the front and side edges. The board has a pair of elongate channels of defined depth formed in the bottom surface. The channels extend longitudinally from the rear edge toward the front edge and taper in depth near the front edge. The channels provide a variety of comfortable, ergonomically designed hand grip positions and also provide stability to the kickboard.

From the above descriptive summary it is apparent how the present invention ergonomic kickboard overcomes the shortcomings of the above-mentioned prior art.

Accordingly, the primary objective of the present invention is to provide a kickboard having a pair of elongate channels formed along a bottom surface thereof for purposes of providing a variety of comfortable, ergonomically designed hand grip positions and kickboard stability.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now be made to the appended drawings. The drawings should not be construed as limiting the present invention, but are intended to be exemplary only.

PREFERRED EMBODIMENT OF THE PRESENT INVENTION

Figure 1:
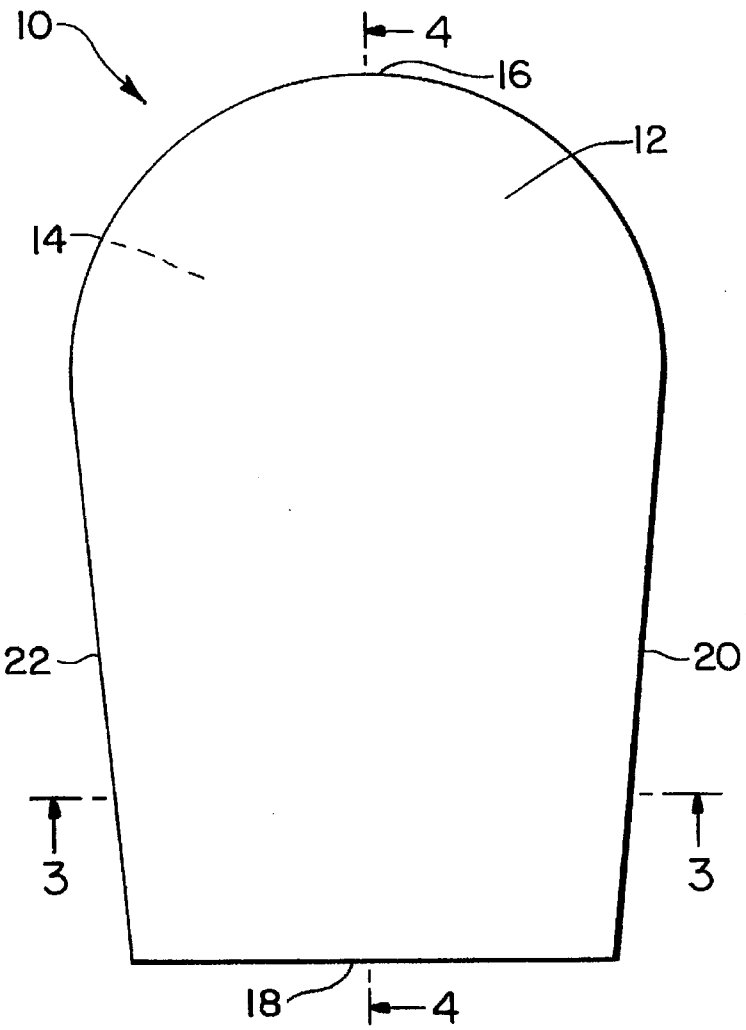
FIG. 1 is a top view of an ergonomic kickboard according to the present invention.

Referring to FIG. 1, there is shown a top view of an ergonomic kickboard 10 according to the present invention. The kickboard 10 has a top surface 12 and a bottom surface 14. The kickboard 10 also has a front edge 16, a rear edge 18, a right side edge 20, and a left side edge 22. These edges 16, 18, 20, 22 border the top and bottom surfaces 12, 14.

The front edge 16 is larger in length than the rear edge 18, while the side edges 20, 22 are of equal length. The front edge 16 is preferably rounded, while the rear and side edges 18, 20, 22 are preferably straight. Thus, the kickboard 10 is tapered in width from the front edge 16 to the rear edge 18. It should be noted, however, that the rear and side edges 18, 20, 22 may be curved or rounded if such is desirable. Also, the front edge 16 may be straight or curved in a different manner than shown if such is desirable. The tapering width of the kickboard 10 is of notable significance since such tapering is part of the reason that the present invention kickboard design does not promote or result in the problem of shoulder impingement and other musculoskeletal dysfunctions as will be described in more detail below.

Figure 2:
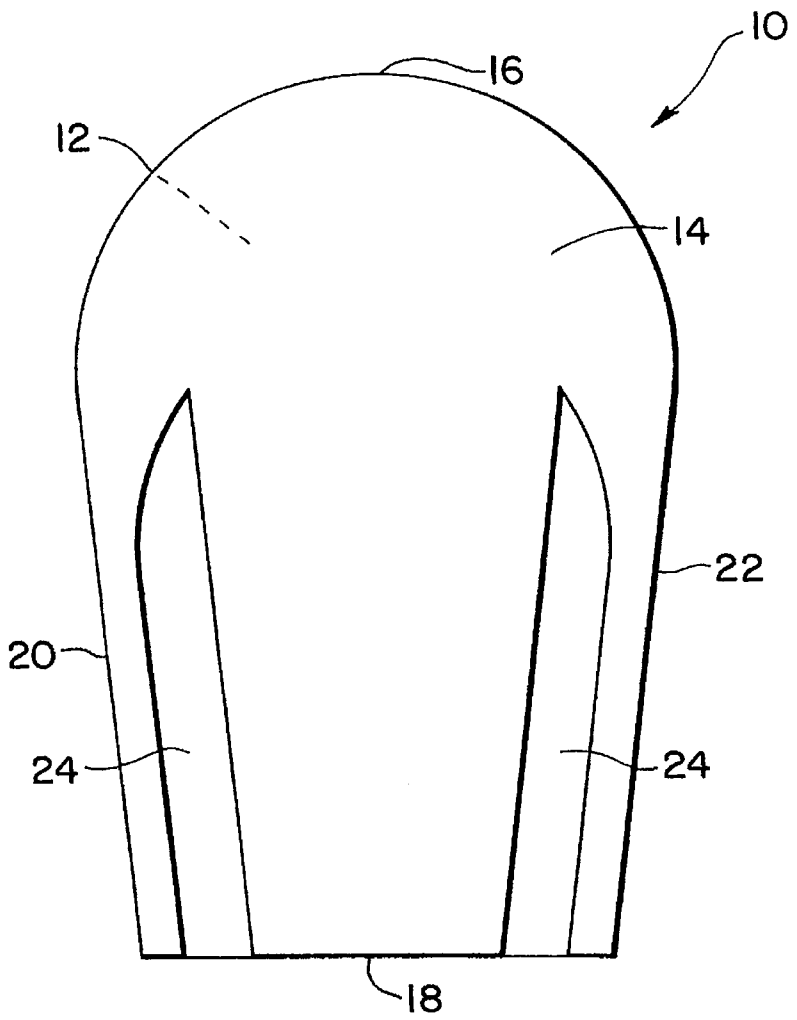
FIG. 2 is a bottom view of the ergonomic kickboard shown in FIG. 1.

Referring to FIG. 2, there is shown a bottom view of the ergonomic kickboard 10. The bottom surface 14 of the kickboard 10 has a pair of elongate channels 24 formed therein, each of which has a depth which is somewhat less than the total thickness of the kickboard 10. The channels 24 extend longitudinally from the rear edge 18 toward the front edge 16 and taper in depth near the front edge 16. The channels 24 are generally parallel with the sides edges 20, 22 of the kickboard 10. The width of the channels 24 may vary, but the width of the channels 24 should be large enough to accommodate the fingers of a user of the kickboard 10. Thus, the main purpose of the channels 24 is to provide gripping leverage to the fingers of a user of the kickboard 10. The channels 24 also provide stability to the kickboard 10 when the same is being used in water or in other fluid bodies.

The combination of the tapering width of the kickboard 10 and the presence of the channels 24 work to provide a user of the kickboard 10 with a variety of comfortable, ergonomically designed hand grip positions which do not promote or result in the problem of shoulder impingement or other musculoskeletal dysfunctions. In fact, the shoulder position of a user of the kickboard 10 is typically in an abducted position when the kickboard 10 is properly gripped. It should be noted that an additional benefit of the tapering width of the kickboard 10 is that the distance between hand grip positions can be varied depending upon the body size of a user.

At this point it should be noted that the kickboard 10 is typically fabricated of a buoyant material, such as styrofoam, or is fabricated of a rigid, lightweight, and airtight material and has a hollow interior so as to promote floatation. It should also be noted, however, that the kickboard 10 may be fabricated of any material, or combination of materials, which achieves the desired goals buoyancy while still providing some degree rigidity.

Figure 3:
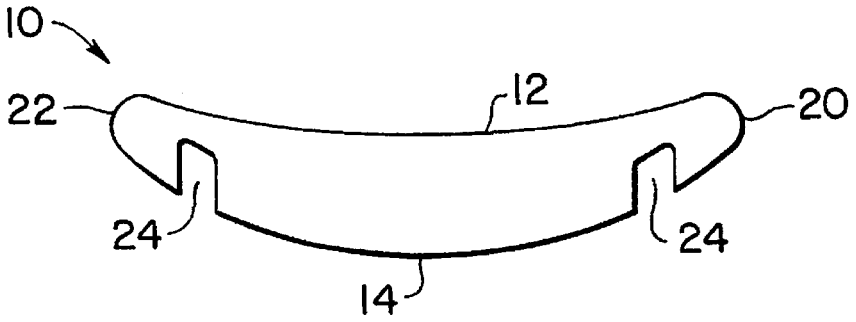
FIG. 3 is a cross-sectional view of the ergonomic kickboard shown in FIG. 1, taken along line 3—3 of FIG. 1.
Figure 4:
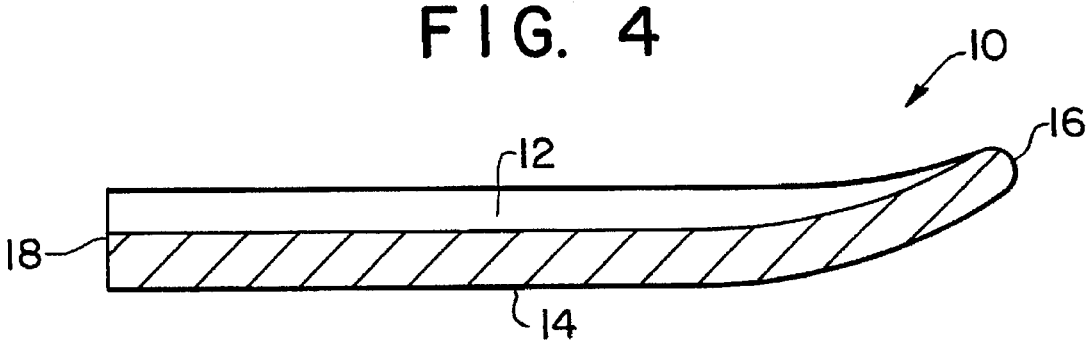
FIG. 4 is a cross-sectional view of the ergonomic kickboard shown in FIG. 1, taken along line 4—4 of FIG. 1.

Referring to FIGS. 3 and 4, there are shown cross-sectional views of the ergonomic kickboard 10. The bottom surface 14 of the kickboard 10 is shown to be substantially convex in shape within the front and side edges 16, 20, 22 (excepting the areas where the channels 24 are formed). The convexly shaped bottom surface 14 of the kickboard 10 is shown to abruptly end along the rear edge 18. This abrupt ending to the kickboard 10 provides a surface where a user may begin to position his or her torso over the kickboard 10. Once a user is positioned with his or her arms over the kickboard 10, the user may then grip the kickboard 10 by clamping the kickboard 10 between the thumb and the forefingers of each hand of the user around each side edge 20, 22 of the kickboard 10, wherein each thumb is placed on the top surface 12 of the kickboard 10 and each set of forefingers are placed within one of the corresponding channels 24.

The convexly shaped bottom surface 14 of the kickboard 10 provides a benefit of allowing a user to "roll" in the water during use of the kickboard 10. Such rolling motion mimics actual swimming conditions and allows the user of the kickboard 10 to acquire and maintain a good "feel" of the water. Also, the convexly shaped bottom surface 14 along the front edge 16 of the kickboard 10 provides for good hydrodynamics as well as allowing a user of the kickboard 10 to vary the "pitch" of his or her body position in the water.

Figure 5:
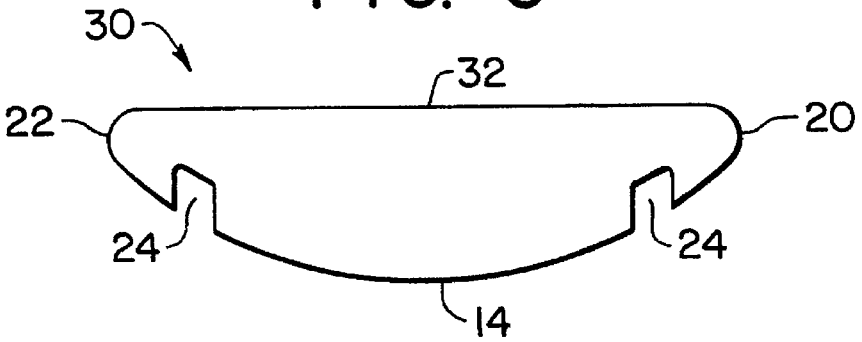
FIG. 5 is a cross-sectional view of an ergonomic kickboard similar to the one shown in FIG. 1 but having a flat top surface, taken along a line similar to that of line 4—4 of FIG. 1.

It should be noted that the top surface 12 of the kickboard 10 is shown to be of slightly concave shape. The concavely shaped top surface 12 of the kickboard 10 provides some additional ergonomic benefits to a user of the kickboard 10. However, such a concavely shaped top surface 12 does not generally provide any relief from shoulder impingement in addition to that obtained from the tapering width of the kickboard 10 and the presence of the gripping channels 24. Thus, referring to FIG. 5, there is shown a cross sectional view of an alternate embodiment of a kickboard 30 according to the present invention. This kickboard 30 is the same as the kickboard 10 shown in FIGS. 1–4 except that this kickboard 30 has a flat top surface 32. Since all other elements of this kickboard 30 are the same as that of the kickboard 10 shown in FIGS. 1–4, the elements are commonly numbered.

With the present invention ergonomic kickboard 10 now fully described, it can thus be seen that the primary objective set forth above is efficiently attained and, since certain changes may be made in the above-described embodiments without departing from the scope of the invention, it is intended that all matter contained in the above description or shown in the accompanying drawings shall be interpreted as illustrative and not in a limiting sense.

What is claimed is:

1. A kickboard providing for a variety of comfortable, ergonomically designed hand grip positions, said kickboard comprising an elongate board having a top surface and a bottom surface, said board having front, rear, and side edges that border said top and bottom surfaces, said bottom surface having a substantially convex shape adjacent said front edge, and extending between said side edges over substantially the whole device, hand grip means comprising a pair of elongate channels formed in said bottom surface, said channels extending longitudinally from said rear edge toward said front edge and tapering in depth near said front edge, and defining a depth sufficient to enable the user of said kickboard to insert the fingers of the hand into said channel and to grip said kickboard securely in use.

2. The kickboard as defined in claim 1, wherein said channels are positioned on said bottom surface near said side edges.

3. The kickboard as defined in claim 1, wherein said top surface is substantially concave in shape within said front and side edges.

4. The kickboard as defined in claim 1, wherein said top surface is substantially flat in shape within said front, rear, and side edges.

5. The kickboard as defined in claim 1, wherein said front edge is larger in length than said rear edge, and wherein said board is tapered from said front edge to said rear edge.

6. The kickboard as defined in claim 1, wherein said front edge is rounded in shape.

7. The kickboard as defined in claim 1, wherein said rear edge is straight.

8. The kickboard as defined in claim 1, wherein said side edges are straight.

9. The kickboard as defined in claim 1, wherein said board is fabricated of a buoyant material.

10. The kickboard as defined in claim 1, wherein said board is fabricated of a rigid, lightweight, and airtight material and has a hollow interior so as to promote floatation.

11. A kickboard providing for a variety of comfortable, ergonomically designed hand grip positions, said kickboard comprising an elongate board having a top surface and a bottom surface, said board having front, rear, and side edges that border said top and bottom surfaces, said front edge being larger in length than said rear edge, said board being tapered from said front edge to said rear edge, said bottom surface having a substantially convex shape adjacent said front edge, and extending between said side edges over substantially the whole device, hand grip means comprising a pair of elongate channels formed in said bottom surface, said channels extending longitudinally from said rear edge toward said front edge and tapering in depth near said front edge, and defining a depth sufficient to enable the user of said kickboard to insert the fingers of the hand into said channel and to grip said kickboard securely in use.

12. The kickboard as defined in claim 11, wherein said channels are positioned on said bottom surface near said side edges.

13. The kickboard as defined in claim 11, wherein said bottom surface is substantially convex in shape within said front and side edges.

14. The kickboard as defined in claim 11, wherein said top surface is substantially concave in shape within said front and side edges.

15. The kickboard as defined in claim 11, wherein said top surface is substantially flat in shape within said front, rear, and side edges.

16. The kickboard as defined in claim 11, wherein said front edge is rounded in shape.

17. The kickboard as defined in claim 11, wherein said rear edge is straight.

18. The kickboard as defined in claim 11, wherein said side edges are straight.

19. The kickboard as defined in claim 11, wherein said board is fabricated of a buoyant material.

20. The kickboard as defined in claim 11, wherein said board is fabricated of a rigid, lightweight, and airtight material and has a hollow interior so as to promote floatation.

* * * * *